US006907840B1

(12) United States Patent
Gaines

(10) Patent No.: US 6,907,840 B1
(45) Date of Patent: Jun. 21, 2005

(54) FOOTBALL FIRST DOWN INDICATOR SYSTEM

(76) Inventor: Marcus A. Gaines, 8400 Forest Mist Dr., Memphis, TN (US) 38125-3332

( * ) Notice: Subject to any disclaimer, the term of this patent is extended or adjusted under 35 U.S.C. 154(b) by 0 days.

(21) Appl. No.: 10/122,002

(22) Filed: Apr. 15, 2002

(51) Int. Cl.[7] ..... A63B 71/06

(52) U.S. Cl. ..... 116/222; 473/438; 473/470; 33/289

(58) Field of Search ..... 116/222, 223, 116/299, 200; 33/DIG. 21, 289; 473/438, 470; 340/323 R, 557

(56) References Cited

U.S. PATENT DOCUMENTS 2,064,745 A * 12/1936 Harrie ..... 33/759
3,482,317 A * 12/1969 Truax ..... 33/289
3,741,662 A * 6/1973 Pioch ..... 356/399
3,752,588 A * 8/1973 Chapman ..... 356/141.1
3,985,356 A * 10/1976 Carlock ..... 33/289
4,014,117 A * 3/1977 Vallillee ..... 33/289
4,090,708 A * 5/1978 McPeak ..... 33/289
4,186,388 A * 1/1980 Robinson ..... 340/556
4,814,986 A * 3/1989 Spielman ..... 700/91
4,837,957 A * 6/1989 Egender ..... 40/488
4,859,986 A * 8/1989 Van Auken et al. ..... 473/467
5,067,245 A * 11/1991 Millard ..... 33/289
5,189,803 A * 3/1993 Caywood ..... 33/289
5,214,491 A * 5/1993 Snowden ..... 356/399
5,294,912 A * 3/1994 Bednarz et al. ..... 340/323 R
5,446,701 A * 8/1995 Utke et al. ..... 367/118
5,535,428 A * 7/1996 King et al. ..... 340/7.52
5,844,487 A * 12/1998 Britt ..... 340/573.4
6,114,963 A * 9/2000 Blake et al. ..... 340/573.4
2002/0151385 A1 * 10/2002 Hemphill ..... 473/415

* cited by examiner

*Primary Examiner*—Christopher W. Fulton
*Assistant Examiner*—Amy R. Cohen

(57) ABSTRACT

A football first down indicator system for providing a method of quickly and accurately determining a first down in football. The football first down indicator system includes a pair of first down marker members each having an elongate housing member, and also having a stub shaft being attached to a bottom of the elongate housing member for resting upon a ground, and further having a down display housing being attached to a top of the elongate housing member; and also includes a plurality of number display members being rotatably disposed in each down display housing; and further includes an assembly for determining and signaling a first down in football.

3 Claims, 4 Drawing Sheets

FOOTBALL FIRST DOWN INDICATOR SYSTEM

BACKGROUND OF THE INVENTION

1. Field of the Invention

The present invention relates to football first down markers and more particularly pertains to a new football first down indicator system for providing a method of quickly and accurately determining a first down in football.

2. Description of the Prior Art

The use of football first down markers is known in the prior art. More specifically, football first down markers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,752,588; U.S. Pat. No. 3,741,662; U.S. Pat. No. 5,214,491; U.S. Pat. No. 4,090,708; U.S. Pat. No. 3,482,317; and U.S. Pat. No. Des. 304,844.

While these devices fulfill their respective, particular objectives and requirements, the aforementioned patents do not disclose a new football first down indicator system. The prior art includes inventions having laser members being used to determined first downs on a football field.

SUMMARY OF THE INVENTION

The general purpose of the present invention, which will be described subsequently in greater detail, is to provide a new football first down indicator system which has many of the advantages of the football first down markers mentioned heretofore and many novel features that result in a new football first down indicator system which is not anticipated, rendered obvious, suggested, or even implied by any of the prior art football first down markers, either alone or in any combination thereof. The present invention includes a pair of first down marker members each having an elongate housing member, and also having a stub shaft being attached to a bottom of the elongate housing member for resting upon a ground, and further having a down display housing being attached to a top of the elongate housing member; and also includes a plurality of number display members being rotatably disposed in each down display housing; and further includes an assembly for determining and signaling a first down in football. None of the prior art describes first down marker members having laser-emitting members to emit laser beams across the field to determine whether a first down was attained.

There has thus been outlined, rather broadly, the more important features of the football first down indicator system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new football first down indicator system which has many of the and many novel features that result in a new football first down indicator system which is not anticipated, rendered obvious, suggested, or even implied by any of the prior art football first down markers, either alone or in any combination thereof.

Still another object of the present invention is to provide a new football first down indicator system for providing a method of quickly and accurately determining a first down in football.

Still yet another object of the present invention is to provide a new football first down indicator system that is easy and convenient to set up and use just any other first down markers.

Even still another object of the present invention is to provide a new football first down indicator system that eliminates the time taken to bring out the chain markers to take measurement for a first down and makes the football game move along more rapidly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
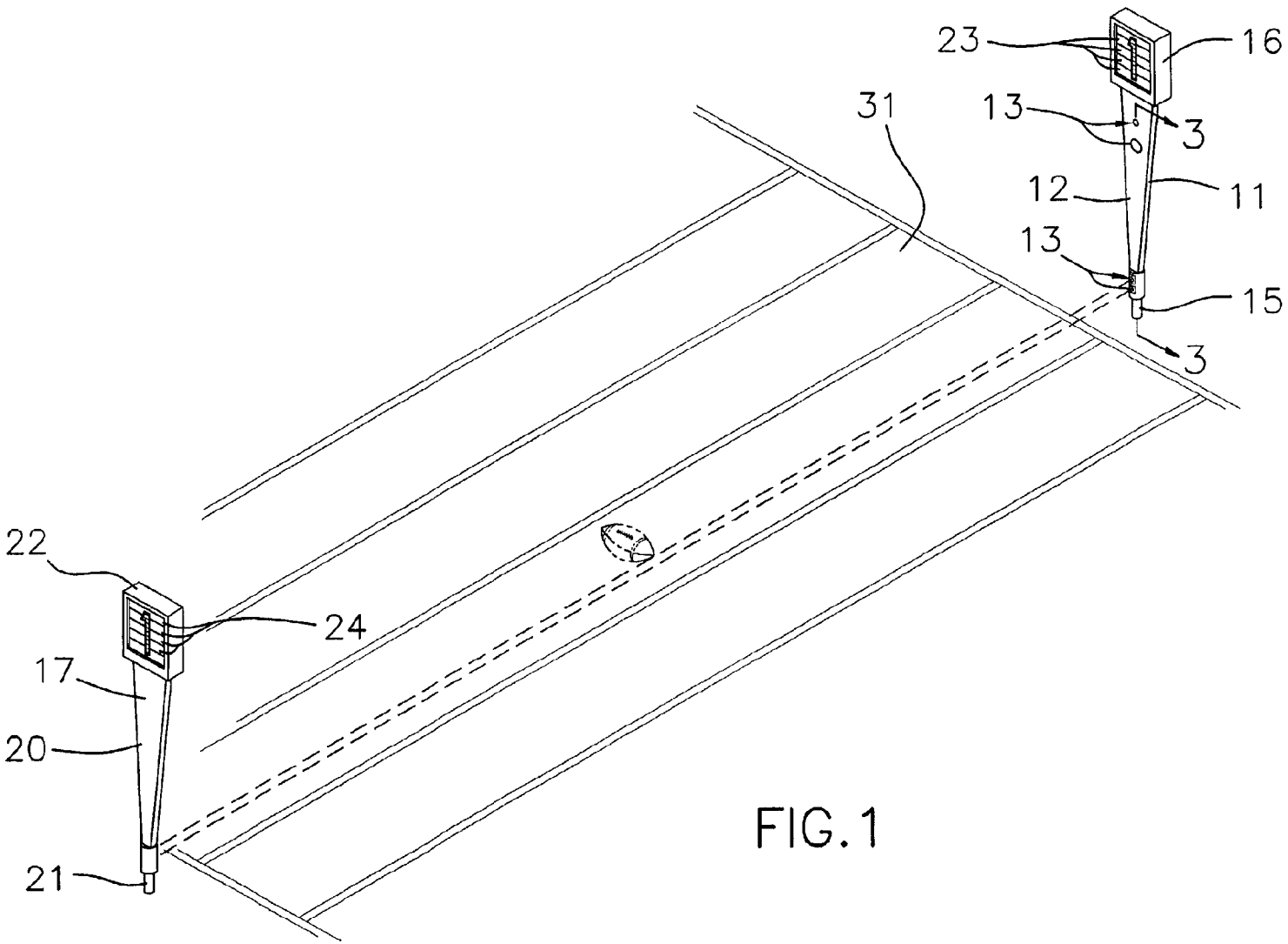
FIG. 1 is a perspective view of a new football first down indicator system according to the present invention and shown in use.
Figure 2:
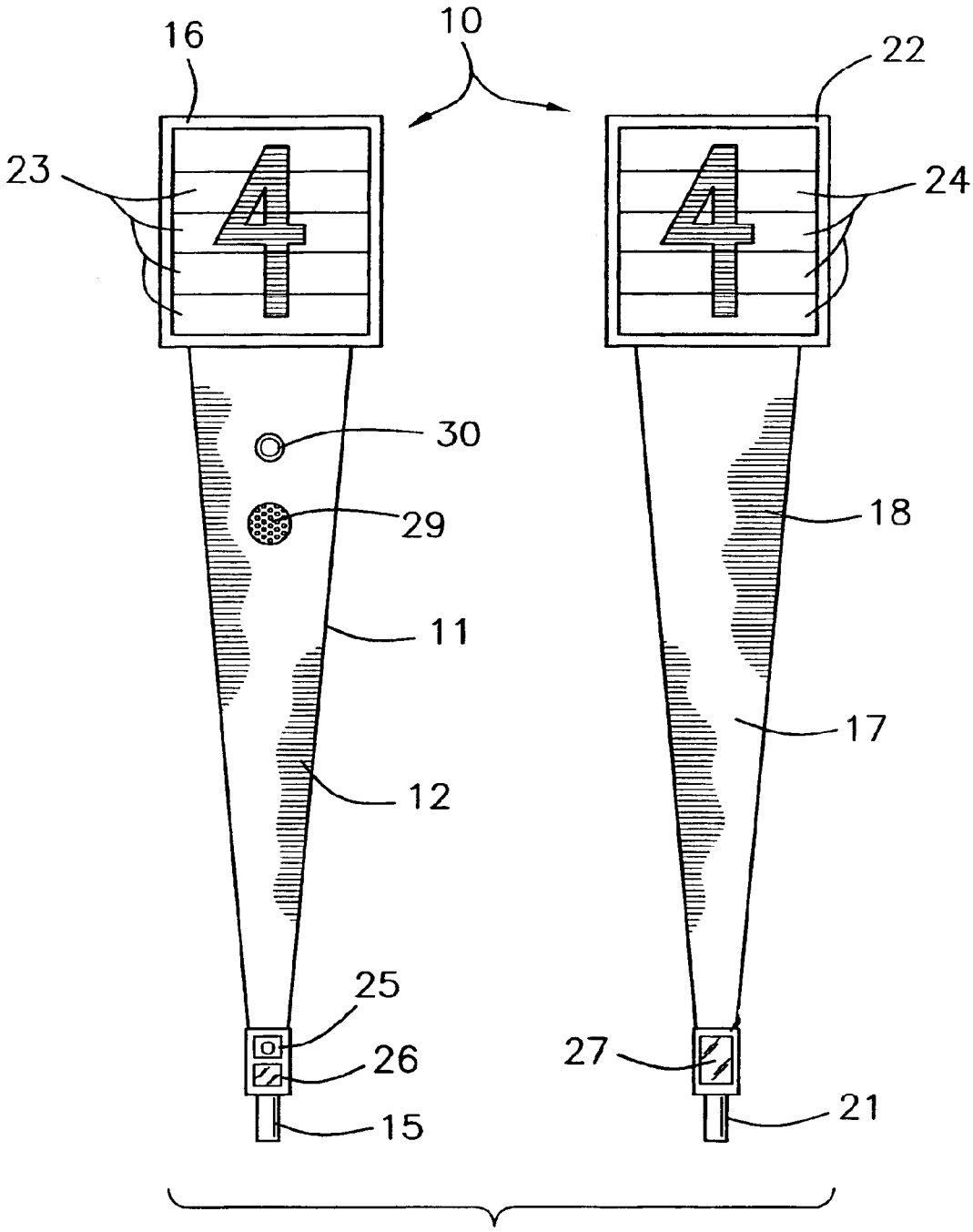
FIG. 2 is a front elevational view of the present invention.
Figure 3:
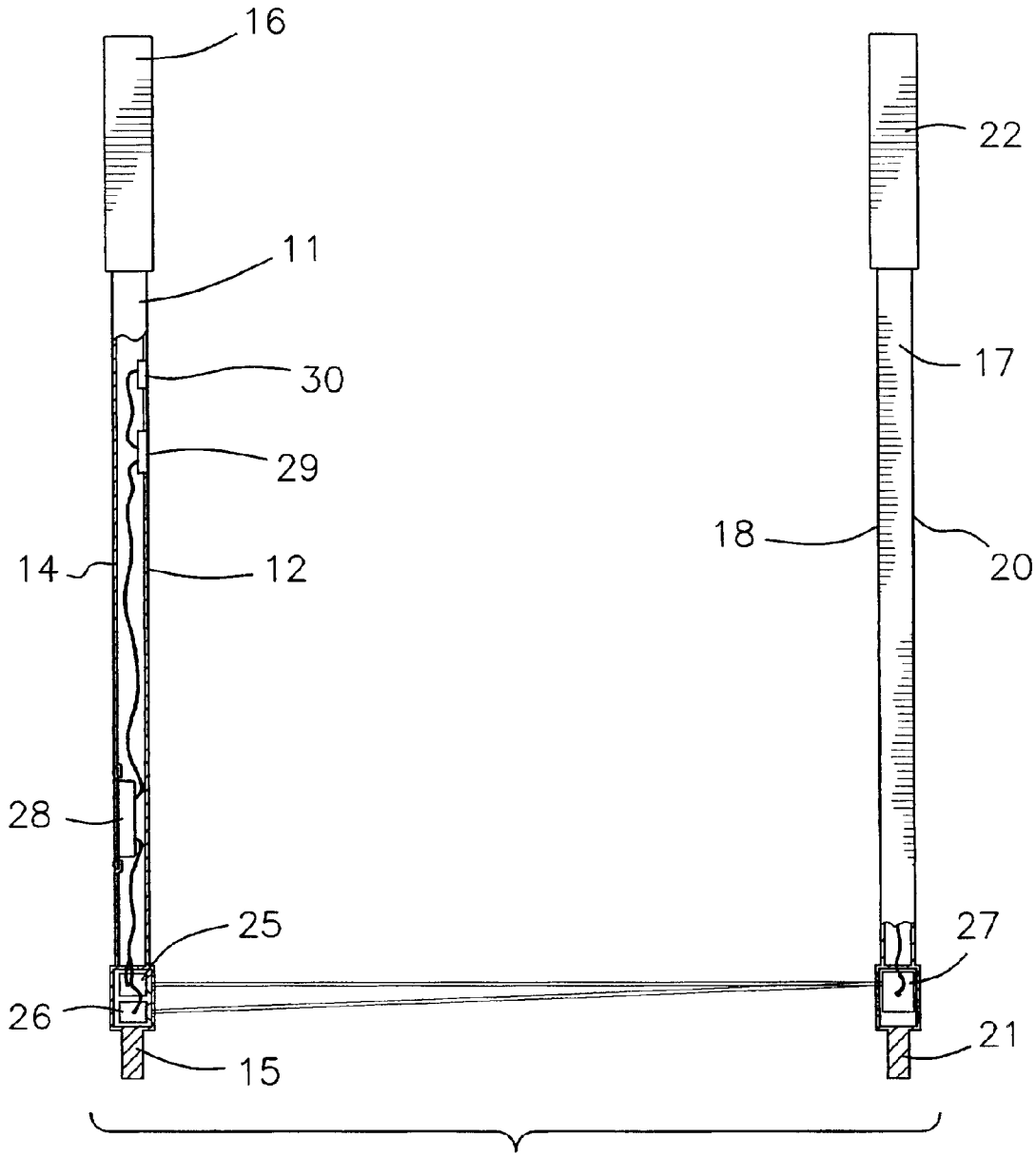
FIG. 3 is a partial cutaway side elevational view of the present invention.
Figure 4:
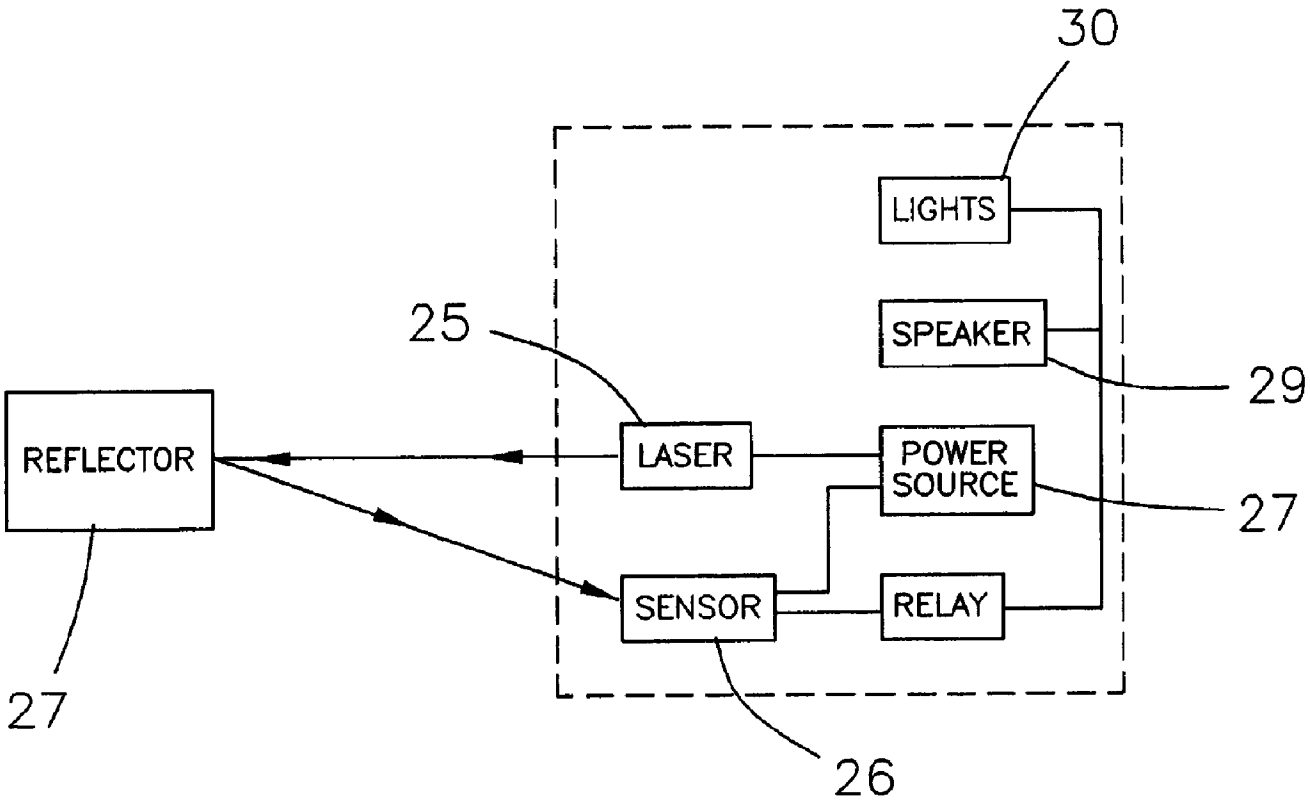
FIG. 4 is a schematic view of the present invention.

With reference now to the drawings, and in particular to FIGS. 1 through 4 thereof, a new football first down indicator system embodying the principles and concepts of the present invention and generally designated by the reference numeral 10 will be described.

As best illustrated in FIGS. 1 through 4, the football first down indicator system 10 generally comprises a pair of first down marker members each having an elongate housing member 11,17, and also having a stub shaft 15,21 being conventionally attached to a bottom of the elongate housing member 11,17 for resting upon a ground, and further having a down display housing 16,22 being conventionally attached to a top of the elongate housing member 11,17. Each of the elongate housing members 11,17 has a front wall 12,18, and a back wall 14,20 which is closely spaced from the front wall 12,18. The front and back walls 12,18,14,20 of the elongate housing members 11,17 are tapered from the top to the bottom. The front wall 12 of a first of the elongate housing members 11 includes openings 13 being disposed therethrough.

A plurality of number display members 23,24 are rotatably and conventionally disposed in each down display housing 16,22. The number display members 23,24 are slats being movably arranged side-by-side in front openings of the down display housings 16,22 and have portions of number indicia displayed thereupon.

A means of determining and signaling a first down in football includes a laser-emitting member 25 being conventionally disposed in one of the openings 13 near the bottom of the first elongate housing member 11 for emitting a laser beam from across a football field to a second of the elongate housing members 17, and also includes a laser-sensor member 26 being conventionally disposed in another one of the openings 13 of the first elongate housing member 11 near the laser-emitting member 25, and further includes a laser-reflecting member 27 such as a mirror being conventionally disposed in an opening 21 of the second elongate housing member 17 for reflecting a laser beam from the laser-emitting member 25 to the laser-sensor member 26, and also includes a battery power supply 28 being conventionally disposed in the first elongate housing member 11 and being conventionally connected to the laser-emitting member 25 and to the laser-sensor member 26. The means of determining and indicating a first down in football further includes a voice box and speaker 29 being conventionally disposed in the first elongate housing member 11 and being conventionally connected to the battery power supply 28 and to the laser-sensor member 26 for producing a vocal message to a first down upon the laser beam being interrupted by a football on the football field 31. The means of determining and indicating a first down in football also includes a power switch 30 being conventionally disposed in one of the openings 13 of the first elongate housing member 11 and being conventionally connected to the battery power supply 28 and to the laser-emitting member 25 and to the laser-sensor member 26 and to the voice box and speaker 29 for the energizing thereof.

In use, the first down marker members are used along opposite sidelines of a football field 31, and are placed at first down positions along the football field 31. The user energizes the laser-emitting member 25 which emits a laser beam across the football field 31 to the laser-reflecting member 27 which reflects the laser beam to the laser-sensor member 26 at a level above the football field 31 where only the football would intercede the laser beam. If any part of the football interrupts the laser beam, the laser-sensor member 26 will activate the voice box and speaker 29 which will give a vocal message that a first down was indeed attained.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the football first down indicator system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A football first down indicator system comprising:

a pair of first down marker members each having an upright elongate housing member, and also having a stub shaft being attached to a bottom of said elongate housing member for resting upon a ground, and further having a down display housing being attached to a top of said elongate housing member; each of said upright elongate housing members having a front wall, and a back wall which is closely spaced from said front wall, said front and back walls of said upright elongate housing members being tapered from said top to said bottom, said front wall of a first of said upright elongate housing members including openings being disposed therethrough;

a plurality of number display members being rotatably disposed in each said down display housing;

a means of determining and signaling a first down in football including a laser-emitting member being disposed in one of said openings near said bottom of said first upright elongate housing member for emitting a laser from across a football field to a second of said upright elongate housing members, and also including a laser-sensor member being disposed in another one of said openings of said first upright elongate housing member near said laser-emitting member, and further including a laser-reflecting member being disposed in an opening of said second of said upright elongate housing members for reflecting a laser beam from said laser-emitting member to said laser-sensor member, and also including a battery power supply being disposed in said first upright elongate housing member and being connected to said laser-emitting member and to said laser-sensor member; and wherein said means of determining and signaling a first down in football further includes a voice box and speaker being disposed in said first upright elongate housing member and being connected to said battery power supply and to said laser-sensor member for producing a vocal message to a first down as determined by said laser beam being interrupted by a football on the football field.

2. A football first down indicator system as described in claim 1, wherein said means of determining and indicating a first down in football also includes a switch being disposed in one of said openings of said first upright elongate housing member and being connected to said battery power supply and to said laser-emitting member and to said laser-sensor member and to said voice box and speaker for the energizing thereof.

3. A football first down indicator system as described in claim 2, wherein said number display members are slats being movably arranged side-by-side in front openings of said down display housings and having portions of number indicia displayed thereupon.

* * * * *